US009199828B2

(12) United States Patent
Steinich

(10) Patent No.: US 9,199,828 B2
(45) Date of Patent: Dec. 1, 2015

(54) MOBILE WORKING MACHINE

(75) Inventor: Klaus Manfred Steinich, Pöring (DE)

(73) Assignee: ASM Automation Sensorik Messtechnik GmbH, Moosinning (DE)

( * ) Notice: Subject to any disclaimer, the term of this patent is extended or adjusted under 35 U.S.C. 154(b) by 406 days.

(21) Appl. No.: 13/315,837

(22) Filed: Dec. 9, 2011

(65) Prior Publication Data

US 2012/0173094 A1 Jul. 5, 2012

(30) Foreign Application Priority Data

Dec. 30, 2010 (DE) ..... 10 2010 056 584

(51) Int. Cl.
*B66C 23/78* (2006.01)

(52) U.S. Cl.
CPC ..... *B66C 23/78* (2013.01)

(58) Field of Classification Search
USPC ..... 212/276–277
See application file for complete search history.

(56) References Cited

U.S. PATENT DOCUMENTS

| | | | | |
|---|---|---|---|---|
| 6,351,696 | B1 * | 2/2002 | Krasny et al. | 701/50 |
| 7,221,151 | B2 * | 5/2007 | Schroeder et al. | 324/207.24 |
| 2007/0084813 | A1 * | 4/2007 | Morath | 212/175 |
| 2012/0279938 | A1 * | 11/2012 | Benton et al. | 212/277 |

FOREIGN PATENT DOCUMENTS

| | | | | |
|---|---|---|---|---|
| DE | 102008058937 | * | 11/2009 | G01L 5/00 |
| JP | 09156478 A | * | 6/1997 | B60S 9/12 |
| JP | 11100193 A | * | 4/1999 | B66C 23/78 |
| JP | 2005126019 A | * | 5/2005 | B60S 9/12 |

* cited by examiner

*Primary Examiner* — Sang Kim
*Assistant Examiner* — Juan Campos, Jr.
(74) *Attorney, Agent, or Firm* — Head, Johnson & Kachigian, P.C.

(57) ABSTRACT

In lateral outriggers, e.g. of a mobile crane touch-free position sensors are arranged for the extension length and the operating range of the mobile crane is limited as a function of the currently measured values. In particular the touch-free magnetostrictive position sensors in a very flat housing can be well arranged between the particular telescope profiles without being exposed to the risk of damages.

8 Claims, 9 Drawing Sheets

MOBILE WORKING MACHINE

I. FIELD OF THE INVENTION

Figure 1A:
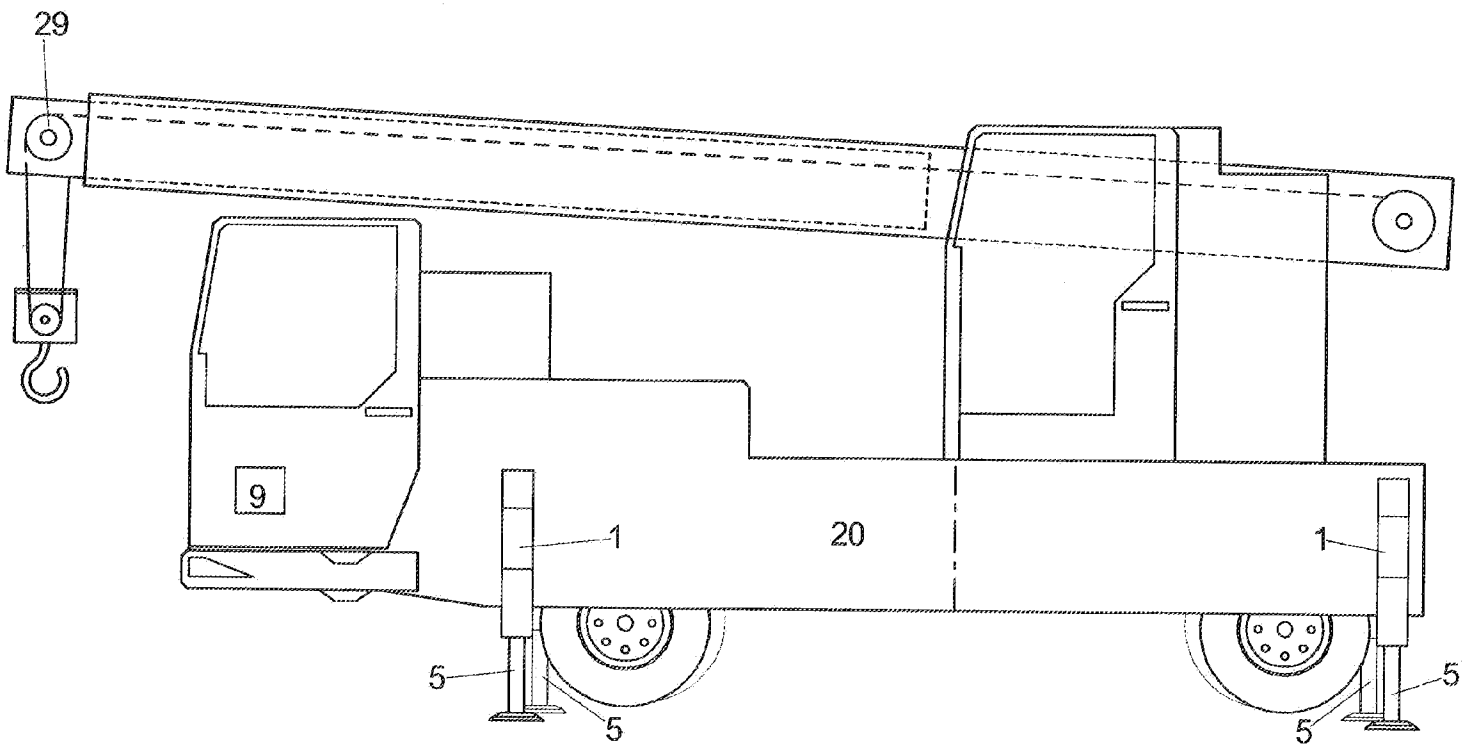

The invention relates to mobile working machines and in particular to their support devices relative to a ground surface.

II. BACKGROUND OF THE INVENTION

Mobile working machines like mobile boom cranes, man lifts, self-propelled concrete mixers are typically not supported relative to a ground surface through their suspensions during operations but are supported by lateral outriggers which are laterally extendable and/or pivotable from the chassis and include support bases that are extendable in downward direction at their free ends. This way, the suspension springs of the vehicle are rendered non-functional and the support surface can be considerably enlarged relative to the suspension and thus the working machine can be stabilized better or improved operating parameters like maximum extension, maximum crane load, etc. can be achieved. A working machine that is not supported correctly can tip over.

Therefore it is already known to safely monitor reaching the extended end position of the telescoping lateral outriggers, either through manually locking the telescoping outrigger arm in an end position through a bolt or automatically in that a sensor indicates reaching the end position of the telescoping rigger arm.

Typically, however, a mobile working machine of this type has to be used under restricting environmental conditions so that the outriggers cannot be extended to the full length in these locations, but can only be extended to an intermediary position which then cause reduced operating parameters of the machine.

With this respect, it is already known to detect predefined intermediary positions of the extension length of the lateral outrigger through particular sensors.

Furthermore, it is known from EP 1 77 2415 A2 to continuously detect the extension length of lateral outriggers through an optical distance measuring system between two profiles of the lateral outrigger that are configured to be telescopable relative to one another.

Therein, the choice of an optical distance measuring device is based on the fact that inductive or magnetic induction sensors cause limitations in the material choice in the environment of the sensor.

Lateral outriggers of this type as illustrated supra can be telescopable and can be moved into a transport position at the vehicle through retracting the telescope from the operating position.

Another option to approach a transport position is folding the lateral outriggers laterally towards the chassis of the vehicle about a vertical pivot axis.

This has the additional advantage that the laterally extended lateral outriggers do not have to protrude precisely at a right angle to the driving direction of the vehicle in operating position, but are adjustable with respect to their angular position which is advantageous for obstacles in the environment of the operating machine.

Pivoting the lateral outriggers about a vertical axis and telescoping the lateral outriggers can also be implemented in a combined manner at a lateral outrigger.

III. DETAILED DESCRIPTION OF THE INVENTION a) Technical Object

Thus it is the object of the invention to provide a mobile operating machine with a support device and a method for its operation which facilitate safe operations of the operating machine.

b) Solution

This object is achieved through the features of the claims 1 and 12. Advantageous embodiments can be derived from the dependent claims.

Through the method where the control of the operating machine automatically limits the maximum permissible operating parameters of the operating machine as a function of the values reported by the sensors, it can be prevented that the operating machine is operated with parameters which lead to an instability of the operating machine and in an extreme case to the operating machine tipping over.

The limitation of the operating parameters should preferably be provided so that impermissible operating parameters at best cannot be selected at all, e.g. with respect to a possible extension length of the crane arm under a particular load, the control automatically prevents extending the crane arm beyond the determined maximum value for the extension length, at least however in this case emits a warning signal to the operator.

The same applies for other operating parameters like the load lifted through the crane or similar.

Thus at least position sensors in the telescoping lateral outriggers report the current extension length to the control and in case the lateral outriggers are pivotable about a vertical pivot axis, additional angle sensors report this angle sensor. For multi-stage telescopes, the control adds the extension lengths of the particular stages.

In a supplemental manner, the control can also be reported the pressure in the particular support bases and/or a slant of the chassis of the operating machine in one or two directions, which so to speak represents a redundant checking of the correctly set operating parameters. Thus, in case the permissible operating parameters are exceeded, the operating machine can tilt or one of the support bases can be loaded less and less and can lift off a ground surface in extreme cases which are then instable situations which are immediately reported by the control and also have to be resolved.

An automatic resolution of an instable condition of this type can include that the chassis that is in the air is moved in a direction of the support bases that are not loaded enough through changing the extension length of the particular outrigger arms so that these receive a higher load.

The control can also operate in reverse direction, namely so that already before supporting and operating the operating machine, the intended maximum operating parameters for the operating machine are entered into the control for this application and the operating machine then checks for adjusting the lateral outriggers with respect to extension length and/or pivot angle, whether this is overall a permissible support distance for the entire support device with respect to the operating parameters and emits a signal with this respect, e.g. an optical signal, either at the central control unit and/or at, each lateral outrigger in particular.

In order to facilitate this, the support device of the mobile operating machine has to include a position sensor at the telescoping lateral outriggers which include support bases at their ends between each pair of profiles of the lateral outrigger which are telescoping relative to one another, wherein the position sensor continuously monitors the extension length of the inner profile relative to the outer profile of the pair and reports the extension length to the control.

In a lateral outrigger with plural telescopes, the control adds the extension lengths of each particular pair of telescoping profiles and determines the total extension length (I) of each outrigger arm therefrom.

Through a computation algorithm stored in the control, the control can determine the maximum permissible operating parameters therefrom, wherein the operating parameters also depend from one another, e.g. cook load and extension length for a crane arm.

In case the lateral outriggers cannot only be extended at a fixated angle, e.g. a right angle relative to the longitudinal axis of the chassis, but can additionally also be pivoted about a vertical pivot axis relative to the chassis of the operating machine, the operating machine should also include an angle sensor for detecting the pivot angle at each lateral outrigger, wherein the angle sensor also puts out its measuring result to the control. Thus the pivot angle also influences the lateral distance of the support base from the chassis.

Preferably a magneto-sensitive position sensor is used as a position sensor in which an encoder magnet is moved touch-free along a sensor rod and only a wall of the housing of the sensor rod can be arranged in the gap there between, but in particular also the wall of a profile that is configured to telescope into itself, even when the profiles are made from steel.

This has the advantage that the encoder magnet and the sensor rod can be arranged on opposite sides of such a profile, which provides a high amount of design freedom.

Thus e.g. the sensor rod can be arranged on the outside of the outermost profile of the lateral outrigger, which greatly facilitates assembly and in particular disassembly in case a replacement of the sensor rod becomes necessary.

On the other hand side, thus the risk of damaging the sensor rod during operations is high, which can be prevented when the sensor rod is arranged in the interior of one of the telescoping profiles extending within in one another and in particular in the distance between two profiles that are telescopable relative to one another.

The profiles typically have circumferentially closed box cross-sections which do not run directly on one another, but support bars are typically permanently arranged at the first profile in the corner portions of the typically rectangular box profiles, wherein the support bars are moveable in a sliding manner on the other profile.

The support bars have a thickness of typically 10 mm to 20 mm. Also a lateral distance of two adjacent support bars is often only 10 mm depending on the size of the box profile.

In order for a sensor rod also to be arrangeable in this intermediary space, wherein the sensor rod not only has to be protected against damages but also against solid or liquid contamination, in particular lubricants provided in the interior of the telescoping lateral outrigger, the sensor rod is arranged in an enveloping tight housing which has to have thinner dimensions than the thickness of the support bars which are less wide than the distance between two adjacent support bars.

Thus, a circumferentially closed aluminum profile is being used which is closed tight by end covers and which undercuts these dimensions.

In spite of that, in a housing a of this type, two sensor rods can be arranged at a distance proximal to the respective narrow sides of the housing, wherein each of the sensor rods can be loaded through a separate encoder magnet.

When only the extension length of a single pair of profiles that are telescopable relative to one another shall be monitored, this represents a redundant position sensor system with high reliability and failure safety.

Otherwise a housing of this type with two sensor rods for a two-stage telescope arm can also be arranged at the center profile while one of the two encoder magnets which are associated with the two sensor rods is attachable at the inner profile and the other is attachable at the outer profile so that through a housing and the two sensor rods included therein the extension length of both stages of a lateral outrigger that is telescopable in two stages can be monitored.

The signal transmission from the position sensor to the control can be provided through cables when this is feasible from a design point of view for a lateral outrigger. However, also a wireless signal transmission, e.g. via radio to the control is feasible for which the position sensor then includes a respective sensor.

In case the lateral outrigger additionally includes an angle sensor for the pivot angle of the lateral outrigger, it is recommended that the angle sensor operates according to the same operating principle as the position sensor, preferably according to a magnetic functional principle and preferably also includes a transmitter for wireless transmission of the signals to the control, so that the sensor can be housed well protected in the interior of the lateral outrigger.

For monitoring the correct function of the control, pressure sensors in the support bases and/or inclination sensors in the chassis of the operating machine can be used, wherein the inclination sensors report a support pressure that is too low at a particular support base or an inclination of the chassis that is too high, which either signals a malfunction of the control or in spite of the warning signal an exceeding of the operating range with respect to the operating parameters of the operating machine, determined by the control.

In a preferred embodiment, the housing, in order to not exceed the predetermined dimensions for the sensor rod of the position sensor, is made from a circumferentially closed aluminum profile with a flat rectangular cross-section and an inner contour which corresponds to a slotted hole, thus respectively includes ends that are respectively rounded in a semicircle.

In the narrow sides of the housing profile, on the outside a groove is arranged respectively extending in longitudinal direction of the profile, preferably an undercut groove, which on the one hand side is used for bolting down end covers at the face side and on the other hand side is used for laterally inserting clamping bases at any longitudinal position, wherein the housing profile can be bolted down in any position, e.g. at one of the telescoping profiles through the clamping bases.

In the inner cross-section that terminates in a semicircle on both sides, there is an insert of the housing inner profile also configured as a circumferentially closed aluminum profile.

The housing inner profile has a thickness so that it can be inserted into the inner cross-section of the housing profiles, but so that its width is narrower and configured approximately semicircular, concave in the narrow sides on the outside.

For the inserted housing inner profile, this yields respectively an approximately circular cavity on the two narrow sides towards the housing profile, wherein a sensor rod can be respectively inserted into the cavity wherein the sensor rod typically also has a circular outer diameter.

The housing inner profile has an inner cross-section which is configured approximately rectangular and which has grooves in the side walls which extend in profile direction, wherein the width of the grooves corresponds to the thickness of the electronic circuit board so that a respective electronic circuit board can be inserted between opposite grooves of the inner cross-section and can be secured therein, wherein the processing circuit for the position rod in particular for both position rods inserted into the housing is arranged on the electronic circuit board and only has to be electrically connected therewith.

For a good support of the housing inner profile in the outer housing profile, protrusions are provided on the outside of the housing inner profile, thus on its broad sides wherein the protrusions extend in the extension direction of the profile and support the housing inner profile at the housing outer profile with minimum clearance.

The housing inner profile typically has a length which corresponds to the length of the outer housing profile, unless end covers are being used which protrude into the outer housing profile.

Then the length of the housing inner profile has to be reduced at least by the penetration lengths of the end covers.

c) Embodiments

Figure 1B:
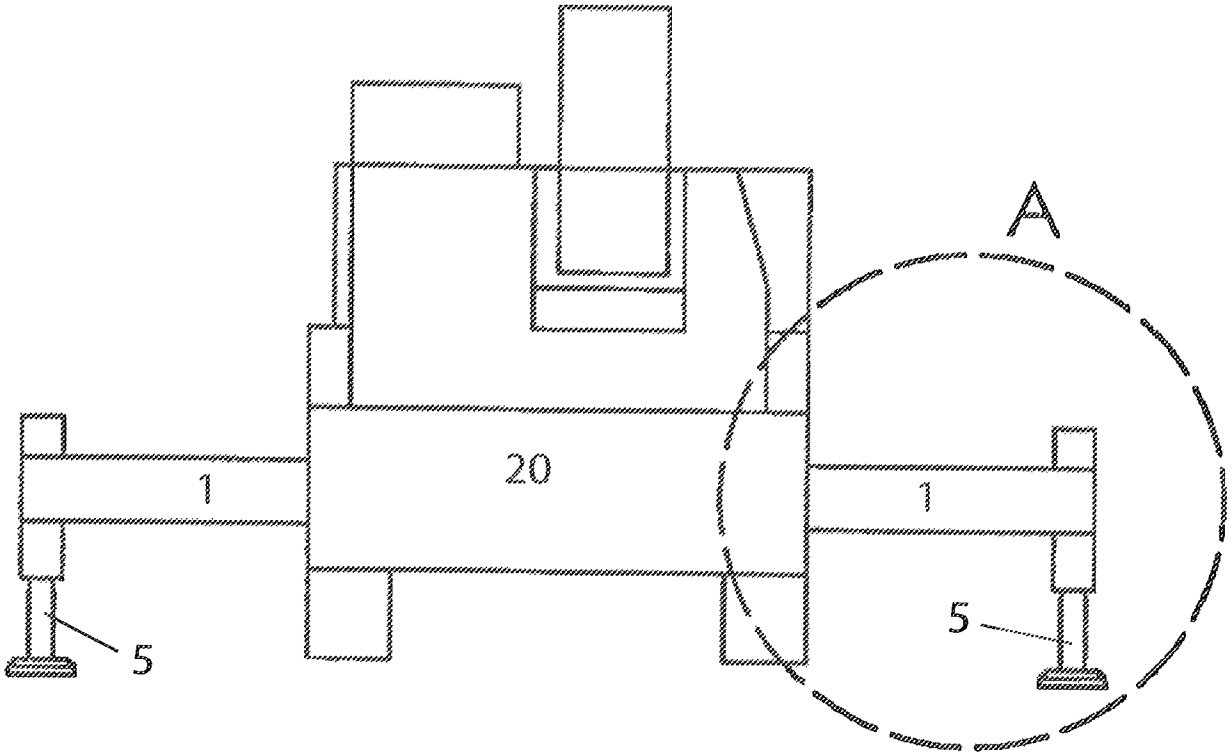
Figure 1C:
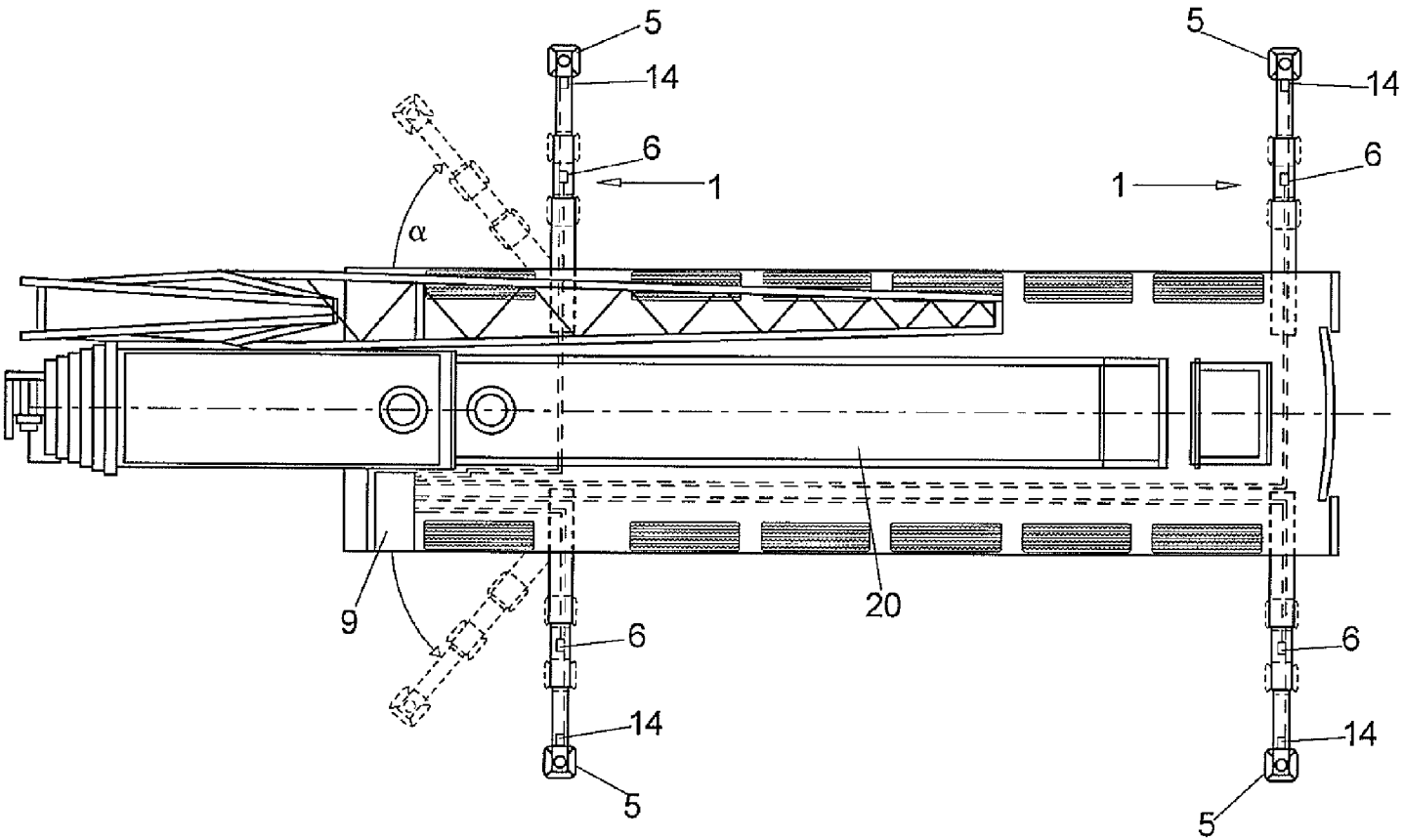
Figure 2A:
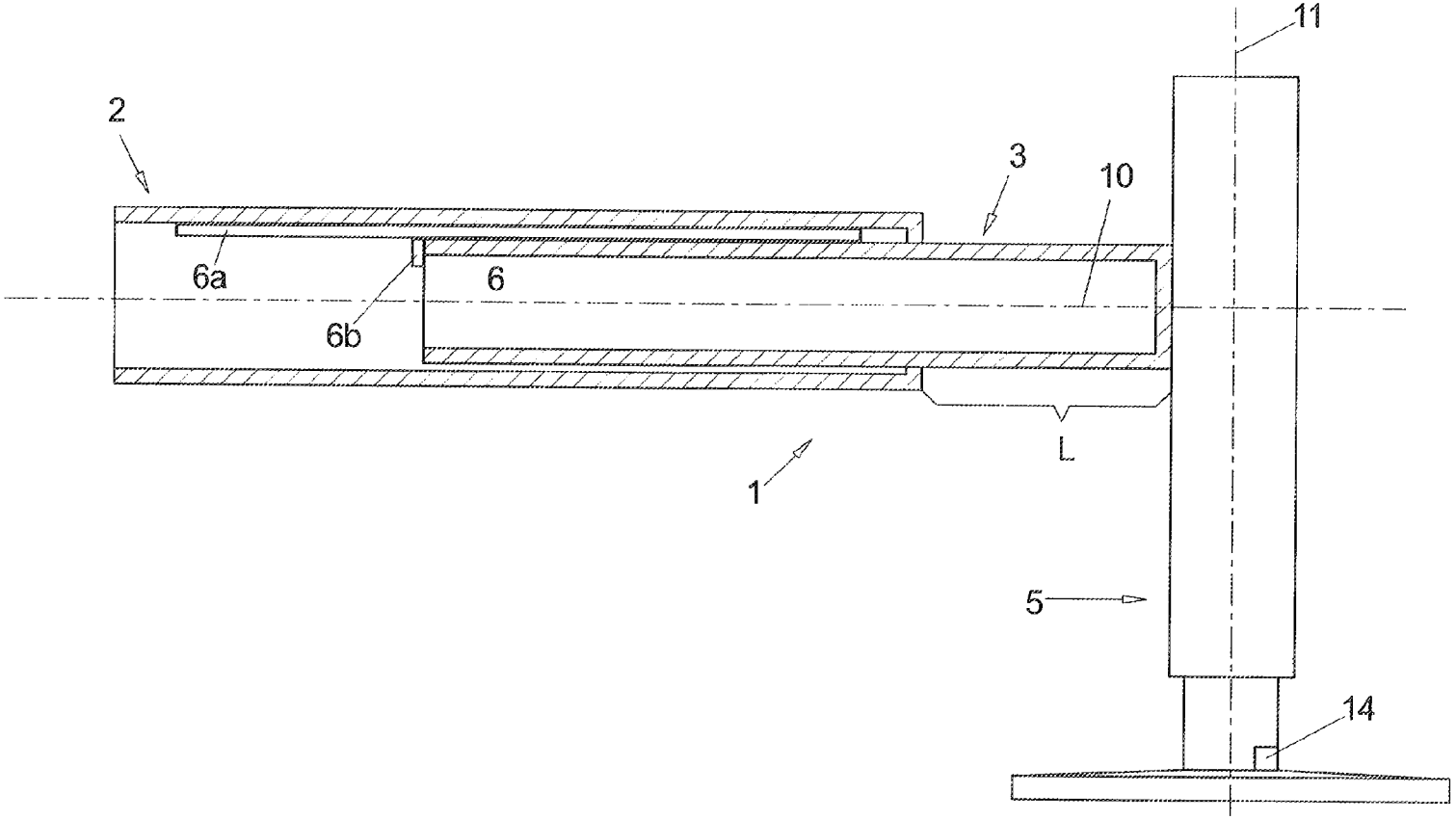
Figure 3A:
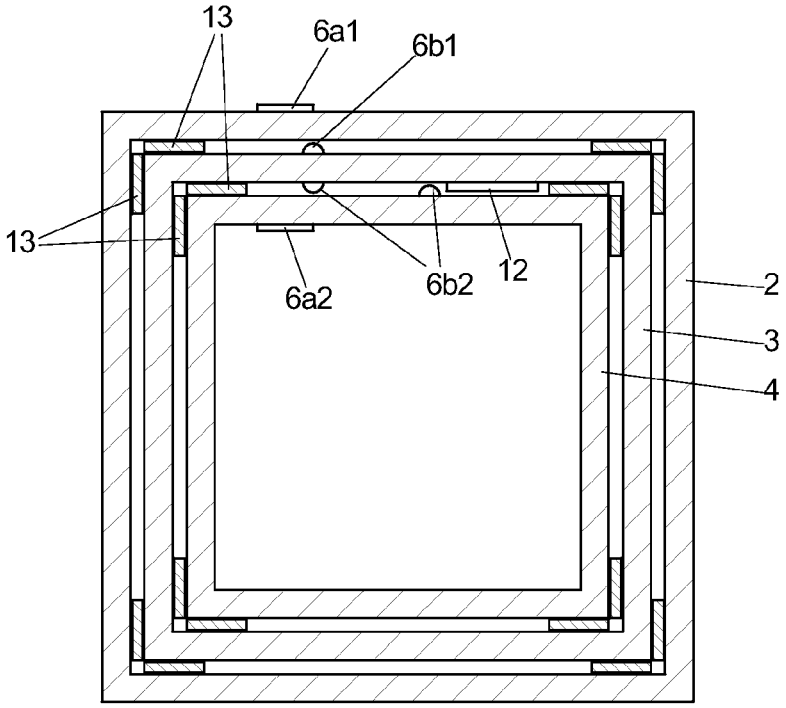
Figure 3B:
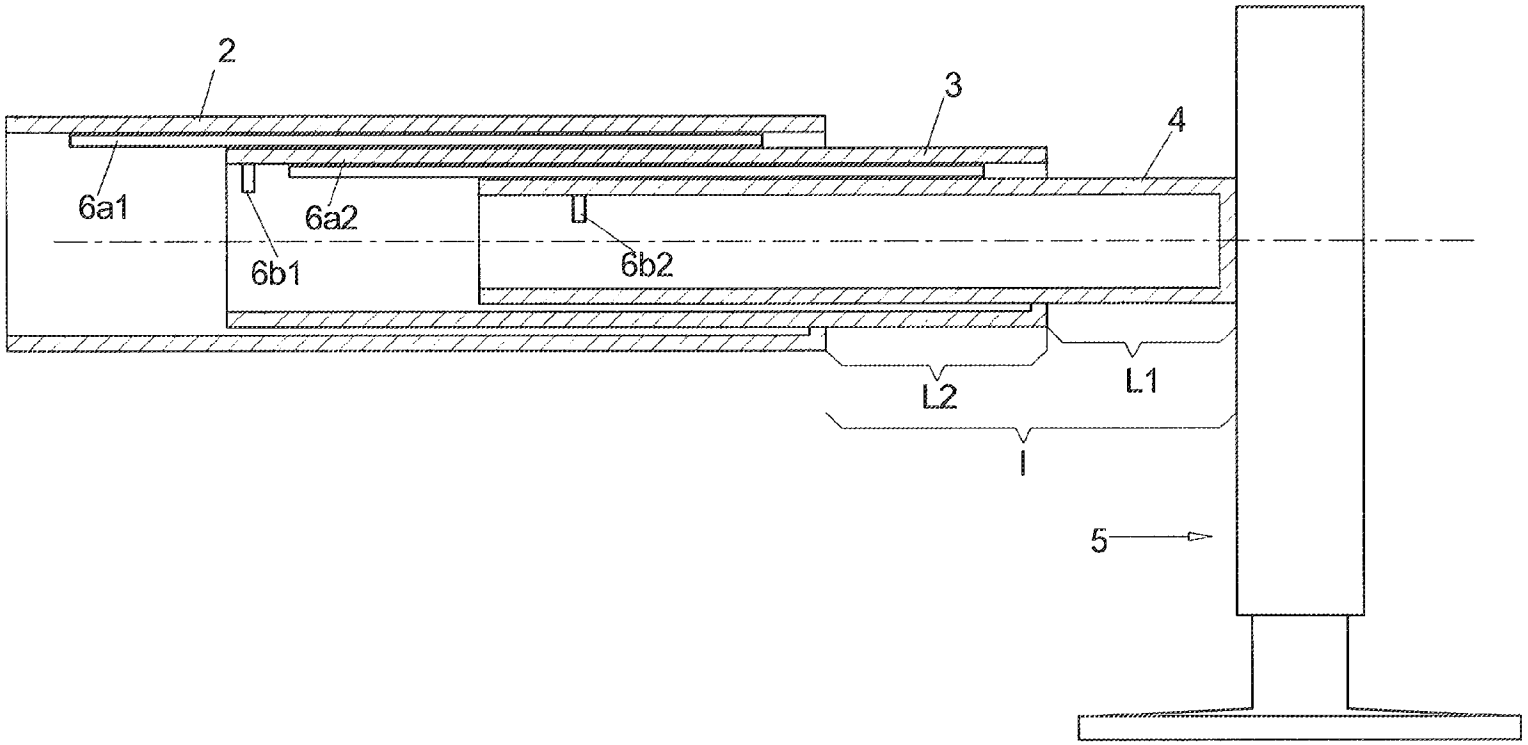

Embodiments of the invention are subsequently described in more detail with reference to a drawing figure, wherein:

FIGS. 1*a*-1*c*: illustrate a mobile working machine;

FIGS. 2*a, b*: illustrate a lateral outrigger of a mobile working machine;

FIG. 3: illustrates a cross-section through a lateral outrigger; and

Figure 4A:
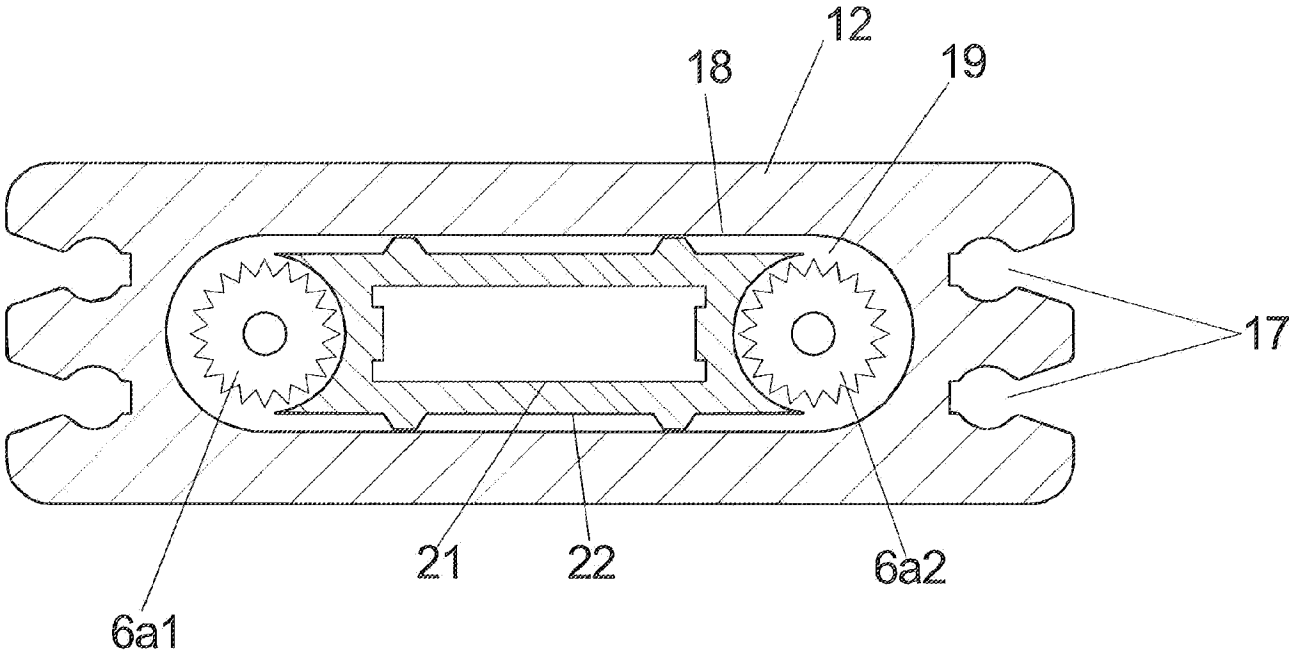
Figure 4B:
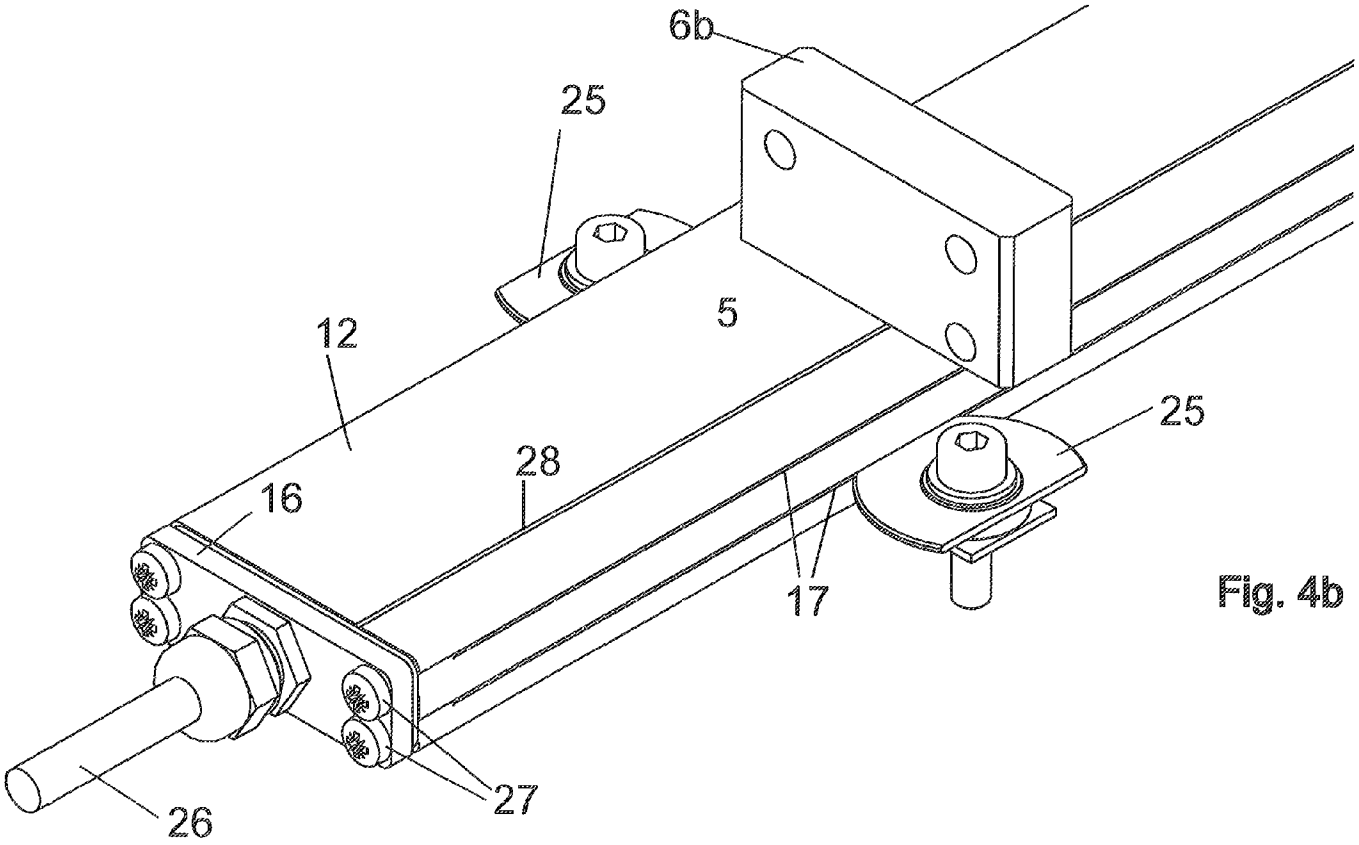

FIGS. 4 *a, b*: illustrate a position sensor.

In FIGS. 1*a* through 1*c*, a mobile crane is illustrated as an embodiment for a mobile working machine.

In order to move from one job site to another, the self-propelled working machine is moved on its own suspension to the new location.

During operations when the crane arm 30 of the mobile crane is extended far forward, backward or laterally and in upward direction and at whose free end loads are appended whose size is detected through a laser sensor 29 at this location, the chassis is supported relative to the ground surface in this operating condition as illustrated in FIGS. 1*a* through 1*c* through lateral outriggers 1 that are laterally extendable from the chassis 20, in that downward extendable support bases 5 are arranged at the free ends of the lateral outrigger 1 wherein the support bases press their lower ends strong enough against the ground surface so that preferably also the wheels of the suspension of the chassis 20 are lifted off from the ground.

The lateral outriggers 1 are telescopable. In order to have the full width of the chassis 20 available as an extension length for a one-stage telescope, the left and the right lateral outriggers are arranged slightly offset to one another in driving direction of the chassis 20 as evident from FIG. 1*a*.

Figure 2B:
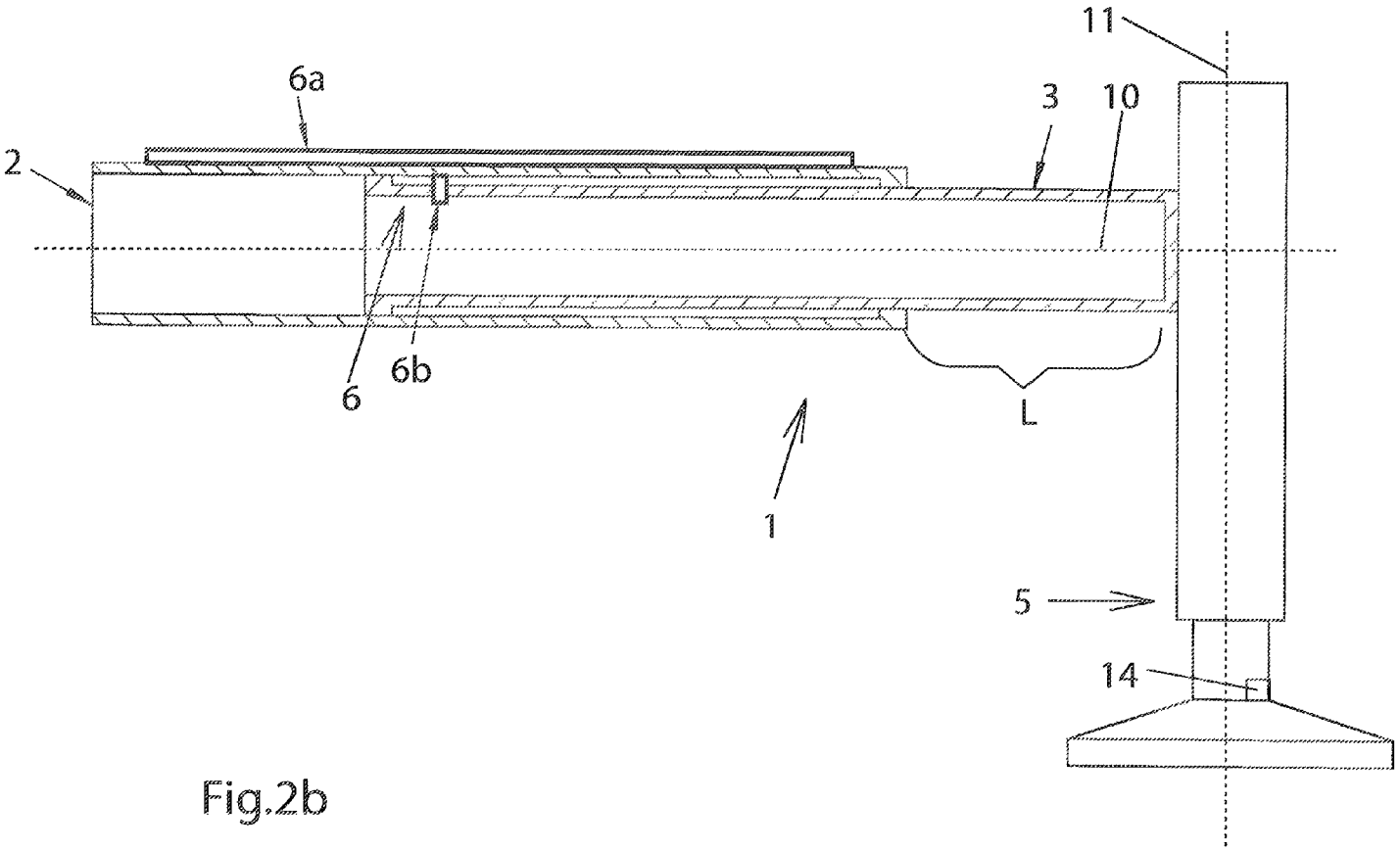

The FIGS. 2*a* and 2*b* illustrate a longitudinal sectional view along the longitudinal direction 10 of a lateral outrigger 1 with a one-stage telescope.

Thus, an inner profile 3 is movably supported in an outer profile 2 in longitudinal direction 10, wherein both are preferably closed box profiles.

The outer profile 2 is thus attached in the chassis of the vehicle 20 and the relative movement of the inner profile 3 is thus caused through hydraulic cylinders which are not illustrated.

The vertical support base 5 is arranged at an end of the extensible profile, typically of the inner profile 3, wherein the vertical support base 5 is also extendable in a telescoping manner in downward direction so that it can be pressed against the ground surface with its lower stand plate.

In order to measure the actual extension length of this one-stage profile, thus in this case the inner profile 3 relative to the outer profile 2 and to report it to the control 9 centrally arranged in the working machine, a position sensor 6, including a sensor rod 6*a* and an encoder magnet 6*b* movable along the sensor rod are attached at the lateral outrigger 1, wherein the sensor rod 6*a* on the one hand side and the encoder magnet 6*b* on the other hand side are fixated at the two profiles that are movable relative to one another.

In the solution according to FIG. 2*a*, the sensor rod 6 is arranged in the intermediary space between the outer profile 2 and the inner profile 3 and fixated at the outer profile 2, which will be subsequently illustrated with reference to FIG. 3.

It is appreciated that the measuring range of the sensor rod 6*a* has to extend over the maximum extension length.

Thus the encoder magnet 6*b* is arranged on an inside of the inner profile 3 and is thus fixated at the inner profile 3, so that the wall of the inner profile 3 is arranged between the encoder magnet 6*b* and the sensor rod 6*a*, wherein the profile 3 is typically made from steel.

For a sufficiently strong magnet, the magnet field extends through the wall to the magneto-sensitive sensor rod 6*a*, which is configured to measure the longitudinal position of the encoder magnet 6*b* along the longitudinal extension of the sensor rod.

Since the sensor rod 6*a* is fixated at the other, in this case outer profile 2, the current extension length l can be measured this way.

FIG. 2*b* differs with respect to the arrangement of the sensor rod and the encoder magnet.

The sensor rod 6*a* is arranged at the outside of the outer profile 2 and thus fixated on the outside of the lateral outrigger. The sensor rod 6*a* thus can be easily mounted and disassembled, in case it is damaged, and replaced.

The encoder magnet 6*b* is in turn fixated in place at the inner profile 3, but is at least partially arranged on the outside of the inner profile 3, so that its magnetic field only has to extend through the wall of the outer profile 2 in order to influence the sensor rod 6*a*.

The FIG. 3 on the other hand illustrate a two stage telescope which is overall made from three profiles, namely in turn the outer profile 2 which is preferably fixated at the chassis 20 of the working machine, the smaller inner profile 3 which is telescopable relative to the profile 2 and an additional, in turn smaller innermost profile 4 which is telescopable relative to the inner center profile 3.

The support base 5 is arranged at the free end of the last extensible profile, thus herein the innermost profile 4. The support base is configured as illustrated in FIGS. 2*a* and 2*b*.

In order to determine the total extension length l of a multi-stage lateral outrigger 1 and in particular to automatically determine it, the extension lengths l1, l2 of the particular telescope stages have to be measured automatically and preferably have to be added by the control 9.

In the cross-sectional illustration of FIG. 3*a*, it is initially apparent that the profiles 2 and 3 are run into one another without radial offset.

Support bars 13 are respectively arranged in the corner portions between two profiles that are telescopable relative to one another, wherein the support bars are respectively fixated at one of the profiles so that the respective other profile can slide along the support bars.

The support bars 13 are often actively lubricated in order to keep wear down. Thus a cavity is created in the center portion between two adjacent support bars 13 of one side of the box shaped profile 2, 3, 4, wherein the cavity among other things can be used for arranging a sensor rod 6*a*, which accordingly must not be thicker than the support bars 13 and must not be wider than the distance between two adjacent support bars 13.

In the left half of FIG. 3*a*, an embodiment is illustrated how the extension lengths of the two telescope stages can be measured through separate sensor rods 6*a*1, 6*a*2 and associated encoder magnets.

Thus e.g. the sensor rod 6*a*1 is attached on outside of the outer profile 2 and the associated encoder magnet 6*b*1 is attached on the outside of the center inner profile 3.

The other sensor rod 6*a*2 on the other hand is arranged on the inside of the innermost profile 4 and the associated encoder magnet 6*b*2 is arranged on the inside of the center inner profile 3.

Each of the two position sensors 6.1, 6.2 measures the extension length l1, l2 of a telescope stage and transmits it to the control 9 which adds the extension lengths to form the overall extension length l.

In the right image half of FIG. 3*a*, however, only a single housing 12 is provided which, however, includes two separate sensor rods 6*a*1, 6*a*2 as described in more detail in FIG. 4.

This housing 12 is arranged and fixated at the center inner profile 3, preferably at its inside. The associated encoder magnets 6*b*1 and 6*b*2 are arranged on one side on the inside of the outer profile 2 and on the other side on the outside of the inner profile 4, so that between these encoder magnets and the sensor rods in the housing 12 in turn only the wall of one of the profiles 2 or 4 is arranged.

In order for a magneto-sensitive sensor and in particular the housing rod 6*a* of a position sensor 6, and can also function for a long time in an environment that is contaminated through grease, humidity and other aggressive materials like in the intermediary space between two profiles of a telescope, the sensor is arranged in a housing 12 which is sealed against contaminations of this type as illustrated e.g. in FIG. 4.

The housing 12 thus typically is an extruded aluminum profile with a closed circumferential cross-section which can be cut to the desired length for each application.

On the face side, a housing 12 of this type is subsequently sealed through a tightly arranged end cover 16.

In the narrow sides of the rectangular cross-section of the housing 12, two symmetric grooves 17 with undercut cross-sections are arranged on each side, wherein the grooves perform a dual function.

On the one hand side attachment screws 27 can be threaded from the front side into the e.g. circular segment shaped undercut portion, wherein the attachment screws extend through the end cover 16 and are used for attaching the end cover at the face of the housing 12.

On the other hand side, disc shaped clamping bases 25 can be inserted laterally at any longitudinal position of the housing 12, wherein a threaded connection of the housing 12 is possible at any location at a surrounding component, e.g. one of the profiles 2, 3, 4 through a borehole of the clamping bases 25.

The line shaped protrusion 28 which exists on the outside of the housing 12 is used as a marker for the position of the sensor rod arranged in the housing 12.

When, as illustrated in the embodiment according to FIG. 4*a*, two sensor rods 6*a*1, 6*a*2 are provided in a housing 12 of this type. The housing 12 includes two protrusions 28 of this type on its outside.

The positioning of the sensor rods 6*a*1, 6*a*2 which have a circular cross-section is provided in that the inner cross-section 18 of the housing 12 has a rectangular shape with semicircular narrow ends, thus approximately corresponding to the shape of a slotted hole, wherein the radius of the semicircular end is identical to or slightly larger than the radius of the circular outer cross-section of the sensor rods 6*a*1, 6*a*2.

In this inner cross-section 18, a housing inner profile 22 is inserted which is also typically an aluminum extruded profile and has a circumferentially closed cross-section with a rectangular basic shape in which the contour of the narrow sides is configured circular segment shaped, approximately circular segment shaped concave, thus in turn with a curvature radius that is identical to or slightly greater than the curvature radius of the outer circumference of the sensor rod 6*a*1.

Thus a cavity is formed in both ends of the inner cross-section 18 between the housing inner profile 22 and the housing 12, wherein exactly one sensor rod 6*a*1, 6*a*2 can be respectively inserted into the cavity.

In thickness direction, the housing inner profile 22 preferably does not contact the housing 12 with its entire broad side but only with the line shaped protrusions 28 at the inner cross-section 18 of the housing 12 in order to facilitate insertion.

The inner cross-section 21 of the housing inner profile 22 in turn is configured approximately rectangular, however with two respective grooves 23 in the two narrow sides which have a width so that an electronic circuit board 24 can be inserted and supported form-locking between a respective pair of grooves 23 arranged opposite to one another, wherein processing electronics for the position sensor 6 is arranged on the printed circuit board.

This way assembly is possible in a very simple manner in that initially the one or the two circuit boards 24 are inserted into the housing inner profile 22 into the grooves 23 arranged at this location and secured in longitudinal direction either through gluing or through friction elements.

Subsequently the completely equipped housing inner profile 22 is inserted into the housing at best together with the two sensor rods 6*a*1, 6*a*2 into the housing 12 and an electrical connection of the sensor rods 6*a*1, 6*a*2 with the processing circuit on the circuit board 24 is established.

In case the processing electronics pass their signals to the outside through a wire conductor, a cable 26 is run, out through one of the end covers 16 in a sealed manner, wherein the leads of the cable are certainly previously connected with the processing circuit on the circuit board 24 in an electrically conductive manner.

REFERENCE NUMERALS AND DESIGNATIONS

1 Lateral outrigger
2 Outer profile
3 Inner profile
4 Innermost profile
5 Support base
6, 6.1, 6.2 Position sensor
6*a*, 6*a*1, 6*a*2 Sensor rod
6*b*, 6*b*1, 6*b*2 Encoder magnet
7 Angle sensor
8 Pivot axis
9 Control
10 Longitudinal direction
11 Vertical direction
12 Housing
13 Support bar
14 Pressure sensor
15 Hollow profile
16 End cover
17 Groove
18 Inner cross-section

19 Cavity
20 Chassis
21 Inner cross-section
22 Housing inner profile
23 Groove
24 Printed circuit board
25 Clamping base
26 Cable
27 Attachment bolts
28 Protrusion
29 Load sensor
30 Crane arm
α Pivot angle
L, L1, L2 Extension length
l Total length

The invention claimed is:

1. A mobile working machine with a lateral support device, comprising:

at least one laterally telescopable lateral outrigger with a first outer profile and at least one second inner profile supported therein;

one respective support base that is extendable in downward direction at a free end of the innermost profile of the at least one lateral outrigger;

at least one position sensor between said first outer profile and said at least one second inner profile telescopable relative to one another of the lateral outrigger, wherein the at least one position sensor continuously measures an extension length L of the inner profile relative to the outer profile, wherein a control which is coupled with the at least one position sensor and wherein viewed in a cross-section of the at least one outrigger, a sensor rod in a housing of the at least one position sensor has a smaller thickness than a plurality of support bars between the first outer and second profile, and is arranged in an intermediary cavity between two adjacent of the plurality of support bars and wherein the support base includes a pressure sensor which measures the contact pressure of the support base on the ground surface and the pressure sensor is also operatively connected with the control and the housing with the sensor rod and a second adjacent sensor rod is arranged at the inner, center profile and encoder magnets loading the two sensor rods are arranged on a side at an outer profile and on another side at the innermost profile.

2. The machine according to claim 1, wherein each position sensor includes the sensor rod and the encoder magnet movable touch-free along the sensor rod and wherein the position sensor is a magneto-sensitive position sensor, with an encoder magnet and wherein the sensor rod includes a housing that is sealed against solid materials and also liquid materials, wherein the housing is made from a circumferentially closed aluminum hollow profile and end covers closing on the face side.

3. The machine according to claim 1, wherein each position sensor is configured redundant and the two sensor rods are arranged in each housing of the at least one position sensor, wherein the sensor rods are loaded by one respective encoder magnet and wherein the housing is arranged so that the housing extends at the outer end of a pair of profiles telescopable relative to one another on the outside or inside of the profile in longitudinal direction of the profile, and the encoder magnet is arranged in the rear end of the inner profile arranged therein and thus in the interior of the outer profile.

4. The machine according to claim 1, wherein a wall of the housing and a wall of the first outer profile is arranged between the sensor rod and the encoder magnet.

5. The machine according to claim 1, wherein signal transmission to the control is performed wirelessly, through radio, for an arrangement of the sensor rod on the inside of the outer profile or at one of the inner profiles, and wherein an angle sensor operates according to the same functional principle as the position sensor, according to a magnetic functional principle, and the angle sensor is functionally integrated with one of the position sensors.

6. The machine according to claim 1, wherein the control during supported operations when the suspension of the working machine is lifted off from the ground surface monitors a change of the pivot angle (α) and/or of the extension lengths (L) and emits a warning signal when exceeding a predetermined deviation.

7. The machine according to claim 1, wherein an inner cross-section of the housing is rectangular with semicircular narrow sides, thus has the cross-sectional shape of a slotted hole and a housing inner profile is supported therein, wherein the housing inner profile has a thickness precisely insertable into the inner cross-section but with respect to a width is narrower than the inner cross-section of the housing and in which the outsides of the narrow sides are configured semicircular concave and in the circular cavities thus created on both sides a sensor rod is arranged which has circular cross-section.

8. A mobile working machine with a lateral support device, comprising:

at least one laterally telescopable lateral outrigger with a first outer profile and at least one second inner profile supported therein;

one respective support base that is extendable in downward direction at a free end of the innermost profile of the at least one lateral outrigger;

at least one position sensor between said first outer profile and said at least one second inner profile telescopable relative to one another of the lateral outrigger, wherein the at least one position sensor continuously measures an extension length L of the inner profile relative to the outer profile, wherein a control which is coupled with the at least one position sensor, and wherein viewed in a cross-section of the at least one outrigger, a sensor rod in a housing of the at least one position sensor has a smaller thickness than a plurality of support bars between the first outer and second profile, and is arranged in an intermediary cavity between two adjacent of the plurality of support bars, and wherein the support base includes a pressure sensor which measures the contact pressure of the support base on the ground surface and the pressure sensor is also operatively connected with the control and a load sensor at a suspension point of a work load, wherein the load sensor measures the load of the external loads and the load sensor is also operatively connected with the control.

* * * * *